US008132337B1

(12) United States Patent
Batey

(10) Patent No.: US 8,132,337 B1
(45) Date of Patent: Mar. 13, 2012

(54) METHOD AND APPARATUS FOR DRYING WOOD PARTICLES/SAWDUST AND OTHER PARTICULATE MATTER

(76) Inventor: Robert Batey, Mount Pleasant, IA (US)

( * ) Notice: Subject to any disclaimer, the term of this patent is extended or adjusted under 35 U.S.C. 154(b) by 1048 days.

(21) Appl. No.: 12/038,600

(22) Filed: Feb. 27, 2008

(51) Int. Cl.
*F26B 11/00* (2006.01)

(52) U.S. Cl. ..... 34/104; 34/210; 34/218; 34/242; 219/400; 165/166; 206/307.1

(58) Field of Classification Search ..... 34/90, 104, 34/105, 210, 218, 248, 167; 206/307.1; 219/400; 165/166, DIG. 391
See application file for complete search history.

(56) References Cited

U.S. PATENT DOCUMENTS 3,758,960 A * 9/1973 McCreary et al. ..... 26/92
4,784,216 A * 11/1988 Bracegirdle et al. ..... 165/64
5,167,274 A * 12/1992 Mueller ..... 165/301
6,328,099 B1 * 12/2001 Hilt et al. ..... 165/166
2005/0061107 A1 * 3/2005 Hampden-Smith et al. .... 75/332

FOREIGN PATENT DOCUMENTS

DE 19944266 A1 * 3/2001
EP 6825 A2 * 1/1980
EP 1084875 A2 * 3/2001
JP 02229521 A * 9/1990

* cited by examiner

*Primary Examiner* — Stephen M. Gravini
(74) *Attorney, Agent, or Firm* — Richard C. Emery

(57) ABSTRACT

A compact low-maintenance moving air modular cabinet wood particles/sawdust dryer having a serpentine path for heated air to move injected wood particles/sawdust through the cabinet, drying it as it goes, together with a system for providing controllable heated airflow and a regulated supply of wood particles/sawdust to be dried.

11 Claims, 2 Drawing Sheets

METHOD AND APPARATUS FOR DRYING WOOD PARTICLES/SAWDUST AND OTHER PARTICULATE MATTER

FIELD OF THE INVENTION

The present invention generally relates to wood particle dryers.

BACKGROUND OF THE INVENTION

In the past, numerous wood particle dryers have been proposed which have drums conceptually similar to a household clothes dryer, as well as combination moving air and conveyor systems for carrying the wood particles/sawdust through the heated air.

While these wood particle dryers have been used extensively in the past, they do have some drawbacks. These dryers often are expensive to manufacture, operate and maintain, and in some instances, are prone to catching fire during operation.

Consequently, there exists a need for improved methods and apparatus for economically and safely drying wood particles/sawdust and other particulate matter.

SUMMARY OF THE INVENTION

It is an object of the present invention to provide an apparatus and method for drying particulate matter in an efficient manner.

It is a feature of one embodiment of the present invention to include a moving-air cabinet-type dryer with an internal serpentine material flow path.

It is an advantage of the present invention to economically manufacture a low-maintenance wood particle dryer.

It is another feature of one embodiment of the present invention to include a modular structure which permits selective connection of multiple cabinet dryers in series to control the dryness of the wood particle output by the system.

It is an advantage of the present invention to achieve improved efficiency in drying wood particles.

It is another feature of one embodiment of the present invention to provide a selective output-to-input feedback mechanism to permit additional drying by passing the wood particle/sawdust output from the cabinet dryer back through the cabinet for additional drying.

The present invention is an apparatus and method for drying sawdust and other particulate matter which is designed to satisfy the aforementioned needs, provide the previously stated objects, include the above-listed features, and achieve the already articulated advantages.

Accordingly, the present invention is an apparatus and method including a moving-air cabinet wood particle/sawdust dryer with compact serpentine material flow path.

BRIEF DESCRIPTION OF THE DRAWINGS

The invention may be more fully understood by reading the following description of the preferred embodiments of the invention, in conjunction with the appended drawings wherein.

DETAILED DESCRIPTION

Figure 1:
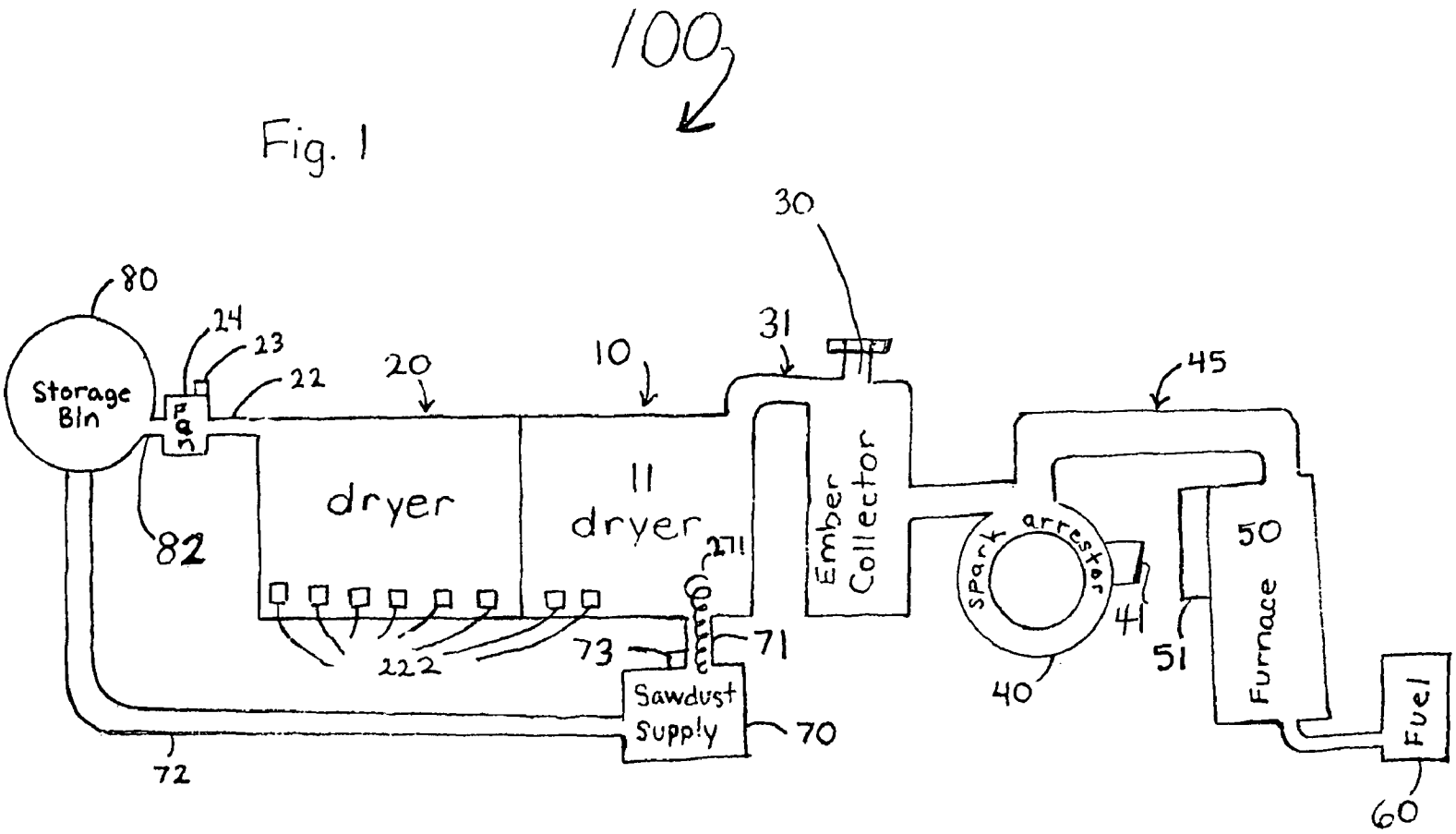
FIG. 1 is a block diagram view of the wood particle/sawdust dryer system of the present invention in use in a representative environment.

Now referring to the drawings wherein like numerals refer to like matter throughout, and more specifically referring to FIG. 1, there is shown a wood particle/sawdust drying system of the present invention generally designated 100, which includes a first cabinet wood particle/sawdust dryer 10, which is shown coupled in series with second cabinet wood particle/sawdust dryer 20.

First cabinet wood particle/sawdust dryer 10 in one embodiment is a cabinet containing a compact serpentine path for directing heated air in combination with wood particle/sawdust to output port 22. As the non-dry wood particle/sawdust is sucked via a vacuum condition created by fan 24 through the serpentine path, contact with the heated air results in evaporation of moisture from the wood particles/sawdust and, therefore, a transfer of moisture from the wood particles/sawdust to the moving air. The longer the time the wood particles/sawdust is exposed to the heated air, the more drying occurs. First cabinet wood particles/sawdust dryer 10 is shown coupled in series with second cabinet wood particles/sawdust dryer 20 so as to extend the length of the serpentine path and, therefore, extend the time the wood particles/sawdust is exposed to the heated air coming in top side heated air input port 211 and, therefore, increase a drying capability of the system 100. Additional modular cabinet wood particles/sawdust dryers similar to first cabinet wood particles/sawdust dryer 10 and second cabinet wood particles/sawdust dryer 20 could be strung together in series to provide yet further drying capability.

The specific dimension of the first cabinet wood particles/sawdust dryer 10 and second cabinet wood particles/sawdust dryer 20 are a matter of design choice and will vary, depending upon the nature of the particulate matter being dried and the desired end product. If wood particles/sawdust having an average particle size of about ¼ inch or smaller is the particulate matter, then the following dimensions might be preferred: both first cabinet wood particles/sawdust dryer 10 and second cabinet wood particles/sawdust dryer 20: 150 inches long, 120 inches high and 36 inches thick. (Note the thickness of the first cabinet wood particles/sawdust dryer 10 is not shown, as it is a direction which is perpendicular to the plane of the Figures). The temperature of the heated air input via top side heated air input port 211 may be in a range of 450° F. to 500° F. (450-500 degrees Fahrenheit.) with 500° F. believed to be ideal. The relative humidity of the heated air is preferably low. The velocity of the air may be quite high. Preferably, the high capacity fan 24 coupled to the output port 22 has a controller 23 coupled thereto for creating a sufficient vacuum and adjusting the rate of airflow through the entire system 100, including furnace 50. The high capacity fan 24 would ideally be set to create a vacuum strong enough that the wood particles/sawdust or other matter being dried becomes suspended in the heated moving air and proceeds through the serpentine path at a rate which maximizes the drying effect on the wood particles/sawdust or other matter to be dried. In one embodiment, the fan could be a 36-inch by 10-inch fan turned at 2722 revolutions per minute.

The system 100 is shown with an ember collector 30 and spark arrestor 40, with controller 41; however, this could be omitted, depending upon the source of heated air entering ember collector to first cabinet wood particles/sawdust dryer connection 31. With the furnace 50, duct 45, and high capacity spark arrestor 40 combination of the present invention, an ember collector 30 may be preferred as the furnace 50 is a solid fuel burning furnace, such as the one described in copending U.S. patent application entitled "Method and Apparatus for Burning Particulate Matter" by Robert Batey, and having Ser. No. 11/559,649 filed on Nov. 14, 2006, which application is hereby incorporated herein in its entirety by this reference. In one embodiment, any source of properly heated air of a proper volume could be substituted for the combination of ember collector 30, spark arrestor 40, controller 41, furnace 50 and furnace fuel supply 60. The system is designed with the intention that the fan 24 creates a vacuum which draws air through the system; it is possible that heated air could be heated and blown through the system in another embodiment of the invention.

The non-dry wood particles/sawdust supply 70 is coupled to the first cabinet wood particles/sawdust dryer 10 via auger 71; however, this means of supplying could be any suitable substitute, such as a gravity-fed supply, a conveyor-assisted supply, etc. A controller 73 for regulating the rate at which wood particles/sawdust or other matter to be dried is provided into the wood particles/sawdust input port 271 may be provided as well. Controller 73 may be an auger-driven controller if an auger is used, or it may be a valve if a gravity-fed system is used; still other suitable controllers could be substituted.

The output of second cabinet wood particles/sawdust dryer 20 is shown drawn through the fan 24 and then to dry wood particles/sawdust storage bin 80 via storage bin supply connection 82. From dry wood particles/sawdust storage bin 70, the material can be fed back to non-dry wood particles/sawdust supply 70 via feedback supply connection 72. The notion of feeding back material for another pass through the first cabinet wood particles/sawdust dryer 10 and second cabinet wood particles/sawdust dryer 20 is optional and may be applicable when a higher level of dryness is desired or the non-dry wood particles/sawdust supply contains extra moisture.

In one embodiment (not shown), there could be more or fewer cabinet dryers disposed in series with first cabinet wood particles/sawdust dryer 10.

Ember collector 30 may be a large container with a screen to prohibit passage of certain embers.

Figure 2:
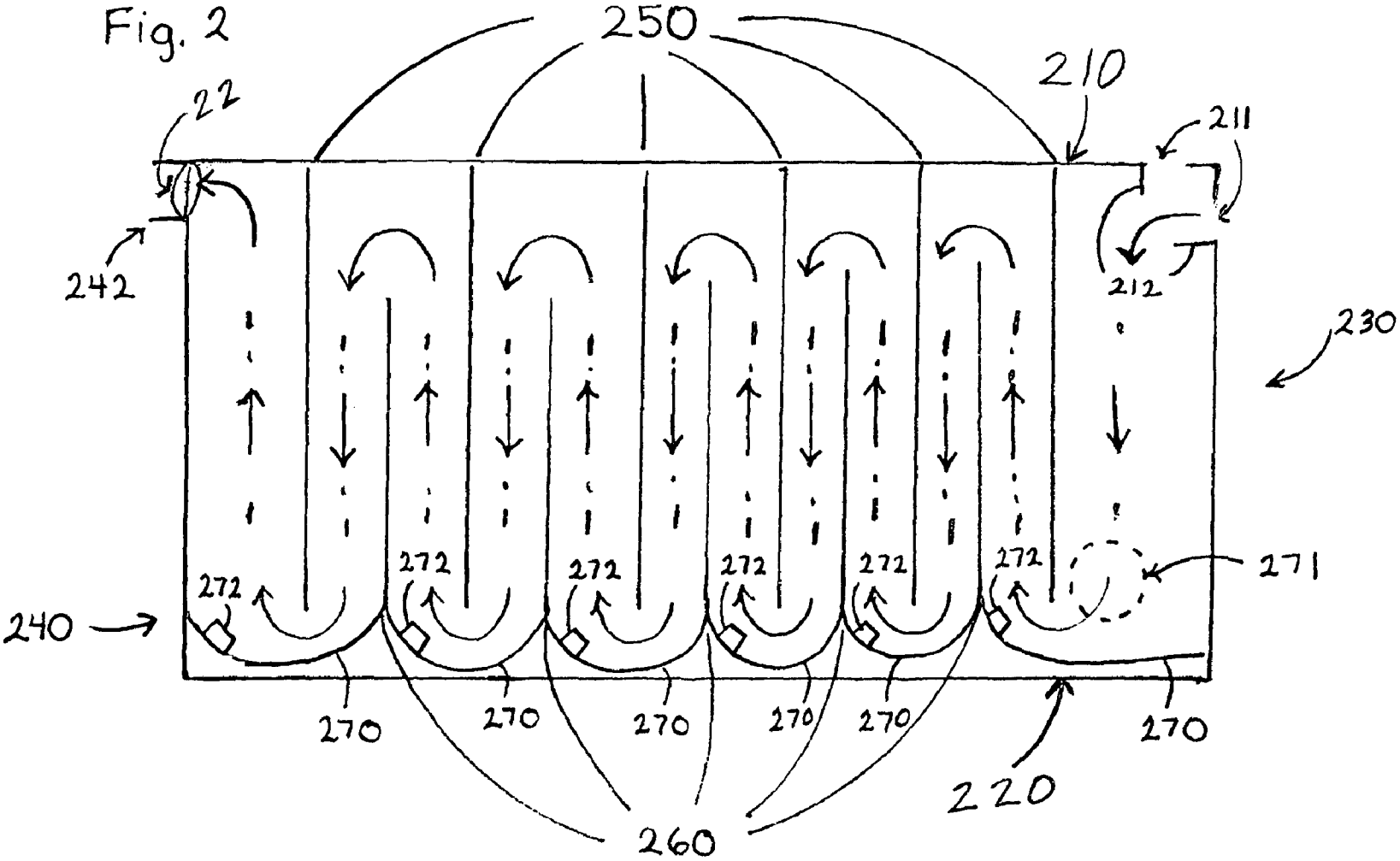
FIG. 2 is a partial view of the cabinet dryer 10 of FIG. 1 after the first panel 11 has been removed to expose the internal structure of cabinet dryer 10. The dotted lines refer to a location in the removed first panel 11 which shows the wood particle/sawdust input port 271, while the dotted and dashed lines refer to airflows of heated air which have suspended particulate matter therein.

Now referring to FIG. 2, there is shown a side view of the first cabinet wood particles/sawdust dryer 10 of FIG. 1, with the first panel 11 having been removed to reveal the underlying structure. The dotted lines refer to location on first panel 11 (not shown) of the wood particles/sawdust input port 271; the dashed and dotted lines represent hot air and a mixture of hot air with wood particles/sawdust entering through wood particles/sawdust input port 271. The first internal vertical section of first cabinet wood particles/sawdust dryer 10 which carries just hot air (before the introduction of the wood particles/sawdust at wood particles/sawdust input port 271) may be wider than the other vertical air passages and may be approximately 18 inches in width. Angle panels (not shown) could be inserted in this first section when it is necessary to adjust or change the velocity of the airflow in order to keep extremely wet matter moving properly.

First cabinet wood particles/sawdust dryer 10 is shown having a cabinet top plate 210, a cabinet bottom plate 220, a cabinet intake end 230 and a cabinet output end 240, with an output port 22 therein. A first side panel 11 (FIG. 1) and an opposing second side panel finish out the remainder of the exterior surfaces of the first cabinet wood particles/sawdust dryer 10. Interior to the first cabinet wood particles/sawdust dryer 10 are numerous top side connected path dividers 250 and bottom corner connecting members 260. The top side connected path divider 250 contacts the cabinet top plate 210 while the bottom corner connecting members 260 do not contact the cabinet top plate 210. This creates a compact serpentine path. Bottom corner connecting member 260 connects with bottom corner spanning member 270, which helps to form an air-turning region to facilitate air movement and reduce buildup of matter to be dried along the cabinet bottom plate 220. Bottom corner connecting member 260 is shown extending only to the point of connection with a bottom corner spanning member 270, but could extend all the way to cabinet bottom plate 220; however, they could terminate at the point of connection with a bottom corner spanning member 270. Many of the parts of the system could be made with 3/16-inch plate steel. The fixed pieces may be welded together, and the movable and removable pieces may be either hinged or bolted.

Also shown on each bottom corner spanning member 270 is an optional high-powered magnet 272, which is included to capture certain metallic matter. Preferably, the high-powered magnets 272 are located so that the matter they collect can be easily removed using one of the removable or hinged panels or windows 222.

Removable panels or hinged transparent windows 222 for cleanouts may be incorporated in either the first side panel or the second side panel, and small moisture removing ports may be made in the cabinet bottom plate 220 and the bottom corner spanning members 270 to help remove moisture that may accumulate when the dryer is not operating. Representative panels 222 and magnets 272 are shown. It should be understood that they, along with the moisture-removing ports, may be located at or near every bottom corner spanning member 270.

Second cabinet wood particles/sawdust dryer 20 and first cabinet wood particles/sawdust dryer 10 may be identical in structure so that the top side heated air input port 211 mates with the output port 22. Top side heated air input port 211 may be actually two ports—one horizontal port on the top side for coupling with an ember collector to first cabinet wood particles/sawdust dryer connection 31 as shown in FIG. 1, or a vertical port in the top end of the cabinet intake end 230 for mating directly with the output port 22 of any other cabinet driers that might be connected in series. Only one of the ports of top side heated air input port 211 would be open at any time, the other being covered by a removable panel.

Second cabinet wood particles/sawdust dryer 20 and first cabinet wood particles/sawdust dryer 10 may mate directly by having a male flange connector 242 on the output port 22 and female flange connector 212 on the top side heated air input port 211 (vertically oriented port).

In operation, the system 100 functions as follows: the fan 24 creates a vacuum and establishes an airflow through the system. Fuel from the furnace fuel supply 60 is fed into the furnace 50 which is configured to rapidly heat high volumes of air sucked into furnace intake port 51 and through the furnace 50, through spark arrestor 40, through the ember collector 30 into the top side heated air input port 211 of first cabinet wood particles/sawdust dryer 10. The heated air is drawn downward through the first channel, where it then picks up wood particles/sawdust which is being augered in through wood particles/sawdust input port 271; the high velocity of the air causes the wood particles/sawdust to become suspended in the moving heated air which carries it through the serpentine path to output port 22.

As shown, the first cabinet wood particles/sawdust dryer 10 and the second cabinet wood particles/sawdust dryer 20 have no moving parts and, therefore, are very low maintenance.

The fan 24 may be the only moving part of the system if the auger 71 and feedback supply connection 72 are omitted, opting for a gravity-fed or other configuration.

Throughout this description, reference may be made to wood particles/sawdust, because many of the beneficial aspects of the present invention are realized with a dryer configured for drying wood particles/sawdust. However, it should be understood that other material to be dried may be substituted; and if the system is configured to accommodate the variations, it may achieve many of the same advantages. Also throughout this description, the terms "top" and "bottom" are used, as well as "side panels". It should be understood that the system could function if the cabinet dryer were laid down on its side, thereby causing the cabinet bottom plate 220 and the cabinet top plate 210 to be vertically extending members.

It is thought that the method and apparatus of the present invention will be understood from the foregoing description and that it will be apparent that various changes may be made in the form, construct steps and arrangement of the parts and steps thereof, without departing from the spirit and scope of the invention or sacrificing all of their material advantages. The form herein described is merely a preferred exemplary embodiment thereof.

I claim:

1. A wood particles/sawdust drying system comprising:

A first box with a substantially rectangular shape and a first side and an opposing substantially parallel second side;

a third side and an opposing substantially parallel fourth side which each are substantially perpendicular to each of the first side and the second side; the third side and the fourth side being separated by a distance substantially the same as a first dimension of the first side and the second side;

a first panel and an opposing substantially coplanar second panel, each of which is coupled to each of the first side, second side, third side and the fourth side;

a plurality of less than full-length dividers disposed inside said box and arranged to be substantially parallel with one of the first side and the third side, said plurality of less than full-length substantially parallel dividers being disposed so as to be perpendicular to, but not contact one of said first side and said third side;

a plurality of parallel blocking dividers interleaved with the plurality of less than full length dividers and configured to form a serpentine path through the rectangular box;

a heated air inlet port and an outlet port on an opposing side of side rectangular box;

a non-dry material inlet port in said first box and disposed along said serpentine path and closer to said heated air input port than to said outlet port;

a source of matter to be dried provided at a controllable delivery rate into the rectangular box through the material inlet port;

a source of controllable heated moving air supplied to said heated air input port with such a velocity so as to cause the matter to be dried to become suspended in the heated moving air and further causing the material to be dried to be moved through the serpentine path without further assistance other than said heated moving air.

2. A wood particles/sawdust dryer of claim 1 wherein said source of heated moving air comprises a furnace positioned in an airflow before entering the heated air inlet port and a fan configured and positioned in the airflow after the outlet port so as to create a heated airflow through the rectangular box.

3. A wood particles/sawdust dryer of claim 2 wherein said source of matter to be dried further comprises an auger and an auger controller.

4. A wood particles/sawdust dryer of claim 3 further comprising a second rectangular box having a serpentine path therethrough for transporting particulate matter; wherein the second rectangular box is coupled in series with the first box.

5. A wood particles/sawdust drying system of claim 4 wherein said second rectangular box is free from any auger injecting therein matter to be dried.

6. A wood particles/sawdust drying system of claim 5 wherein said second rectangular box has an inlet port which mates with an outlet port of the first box.

7. A wood particles/sawdust drying system of claim 1 wherein said matter to be dried is sawdust.

8. A wood particles/sawdust drying system of claim 1 wherein said first box has no moving parts therein, which are configured to move matter to be dried through the first box.

9. A wood particles/sawdust drying system of claim 1 further comprising a plurality of movable members therein for gaining access to lower portions of the first box.

10. A wood particles/sawdust drying system of claim 9 further comprising a plurality of magnets in a lower portion of said first box.

11. A wood particles/sawdust drying system of claim 1 further comprising a feedback loop for causing partially dried matter which once has passed through the first box to exit and then reenter to further dry the partially dried matter.

* * * * *